US005927554A

United States Patent [19]

Bartlow

[11] Patent Number: 5,927,554

[45] Date of Patent: Jul. 27, 1999

[54] TWO-FLUID DISPENSER

[76] Inventor: Robert M. Bartlow, 1185 S.W. Warren Ave., Topeka, Kans. 66604-1645

[21] Appl. No.: 08/912,531

[22] Filed: Aug. 18, 1997

[51] Int. Cl.[6] ..... B67D 5/60

[52] U.S. Cl. ..... 222/145.5; 222/129; 222/209; 222/481.5

[58] Field of Search ..... 222/94, 129, 145.1, 222/145.5, 209, 215, 481.5

[56] References Cited

U.S. PATENT DOCUMENTS

| | | | |
|---|---|---|---|
| 5,553,748 | 9/1996 | Battle | 222/94 |

FOREIGN PATENT DOCUMENTS

| | | | |
|---|---|---|---|
| 0365379 | 4/1990 | European Pat. Off. | 222/94 |
| 2017292 | 10/1971 | Germany | 222/94 |
| 1103534 | 2/1968 | United Kingdom | 222/94 |
| 2039848 | 8/1980 | United Kingdom | 222/94 |
| 9419251 | 9/1994 | WIPO | 222/94 |

*Primary Examiner*—Joseph A. Kaufman

[57] ABSTRACT

A two-fluid dispenser is provided including a housing with a plurality of rigid walls. The housing further has at least two squeezable compartments each having a flexible wall being coextensive with the rigid walls of the housing. The compartments adapted to be depressed independently and coincidentally for dispensing contents stored therein alone or in a mixture.

2 Claims, 3 Drawing Sheets

TWO-FLUID DISPENSER

BACKGROUND OF THE INVENTION

1. Field of the Invention

The present invention relates to a two-fluid dispenser and more particularly pertains to dispensing two fluids either independently or coincidentally.

2. Description of the Prior Art

The use of dispensers is known in the prior art. More specifically, dispensers heretofore devised and utilized for the purpose of dispensing various fluids are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,269,441 to O'Meara; U.S. Pat. No. 4,984,715 to Green; U.S. Pat. No. 5,052,590 to Ratcliff; U.S. Pat. No. 4,274,556 to Thiessen; U.S. Pat. No. Des. 323,445 to Shinyder; and U.S. Pat. No. 5,437,381 to Herrmann.

In this respect, the two-fluid dispenser according to the present invention substantially departs from the conventional concepts and designs of the prior art, and in so doing provides an apparatus primarily developed for the purpose of dispensing two fluids either independently or coincidentally.

Therefore, it can be appreciated that there exists a continuing need for a new and improved two-fluid dispenser which can be used for dispensing two fluids either independently or coincidentally. In this regard, the present invention substantially fulfills this need.

SUMMARY OF THE INVENTION

In view of the foregoing disadvantages inherent in the known types of dispensers now present in the prior art, the present invention provides an improved two-fluid dispenser. As such, the general purpose of the present invention, which will be described subsequently in greater detail, is to provide a new and improved two-fluid dispenser which has all the advantages of the prior art and none of the disadvantages.

To attain this, the present invention essentially comprises an intermediate housing with an oval horizontal cross-sectional. Such housing further has an oval top face, an oval bottom face, an arcuate front face, an arcuate rear face and a pair of ends defined by an interconnection between the front face and the rear face defining an interior space. As shown in FIG. 5, the interior space has a rigid central vertical divider integrally coupled between the ends and the top face and bottom face of the intermediate housing. The divider partition the interior space thereby defining a front compartment and a rear compartment. As can best be seen in FIG. 5, a first portion of the front face is rigid and a second portion thereof is flexible. With regard to the rear compartment, a first portion of the rear face is flexible and a second portion thereof is rigid. With reference now to FIG. 4, a lower air release portion is coupled to the bottom face of the intermediate housing. A first air release valve resides in communication with the rear compartment of the housing. A second air release valve is in communication with the front compartment of the housing. It should be noted that only one of the valves is shown in the Figures. Further provided is an upper spout portion coupled to the top face of the intermediate housing. The spout has a top opening in communication with both the rear compartment of the housing and the front compartment of the housing. Associated therewith is a pair of one-way valves coupled between the top opening and the respective rear compartment and front compartment of the housing. Such valves are adapted for allowing fluid to exit the respective compartment to the top opening only upon the application of manual pressure thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved two-fluid dispenser which has all the advantages of the prior art dispensers and none of the disadvantages.

It is another object of the present invention to provide a new and improved two-fluid dispenser which may be easily and efficiently manufactured and marketed.

It is a further object of the present invention to provide a new and improved two-fluid dispenser which is of a durable and reliable construction.

An even further object of the present invention is to provide a new and improved two-fluid dispenser which is susceptible of a low cost of manufacture with regard to both materials and labor, and which accordingly is then susceptible of low prices of sale to the consuming public, thereby making such two-fluid dispenser economically available to the buying public.

Still yet another object of the present invention is to provide a new and improved two-fluid dispenser which provides in the apparatuses and methods of the prior art some of the advantages thereof, while simultaneously overcoming some of the disadvantages normally associated therewith.

Still another object of the present invention is to dispense two fluids either independently or coincidentally.

Lastly, it is an object of the present invention to provide a new and improved two-fluid dispenser is provided including a housing with a plurality of rigid walls. The housing further has at least two squeezable compartments each having a flexible wall being coextensive with the rigid walls of the housing. The compartments adapted to be depressed independently and coincidentally for dispensing contents stored therein alone or in a mixture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
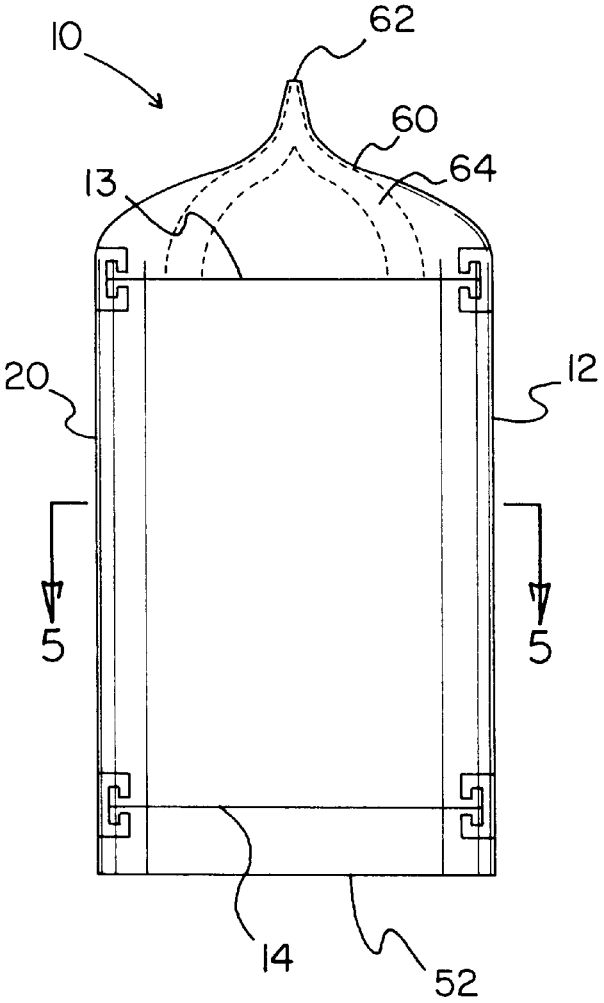
FIG. 1 is a perspective illustration of the preferred embodiment of the two-fluid dispenser constructed in accordance with the principles of the present invention.
Figure 2:
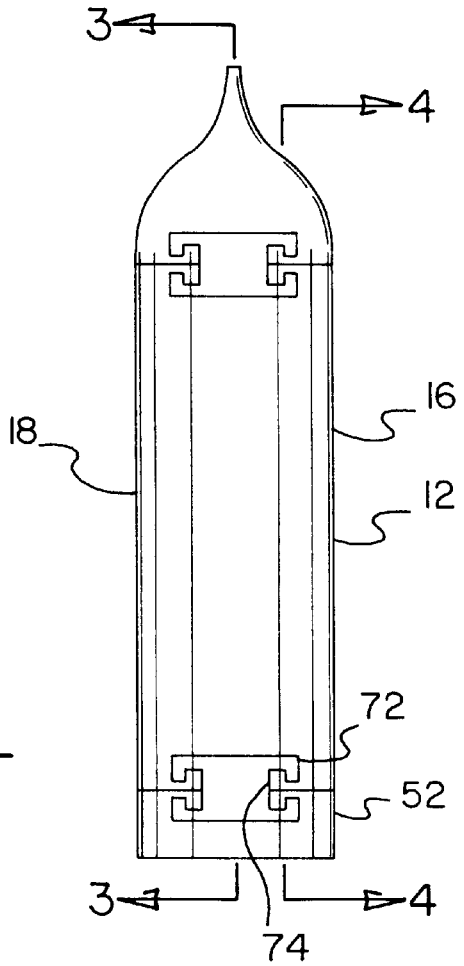
FIG. 2 is a side elevational view of the present invention.
Figure 3:
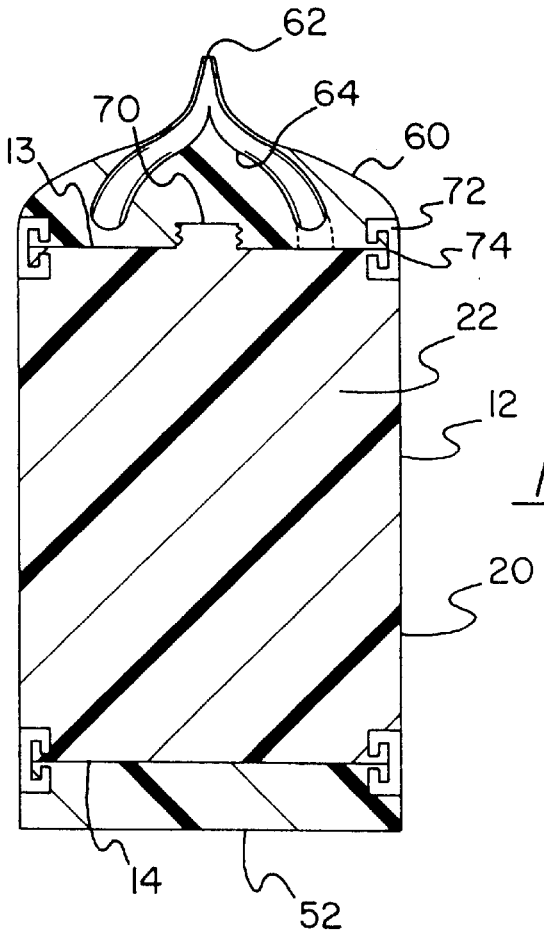
FIG. 3 is a cross-sectional view showing the central divider taken along line 3—3 shown in FIG. 2.

With reference now to the drawings, and in particular to FIG. 1 thereof, a new and improved two-fluid dispenser embodying the principles and concepts of the present invention and generally designated by the reference numeral 10 will be described.

The present invention, the new and improved two-fluid dispenser, is comprised of a plurality of components. Such components in their broadest context include an intermediate housing, spout, air valve portion, and a pair of one-way valves. Such components are individually configured and correlated with respect to each other so as to attain the desired objective.

Figure 5:
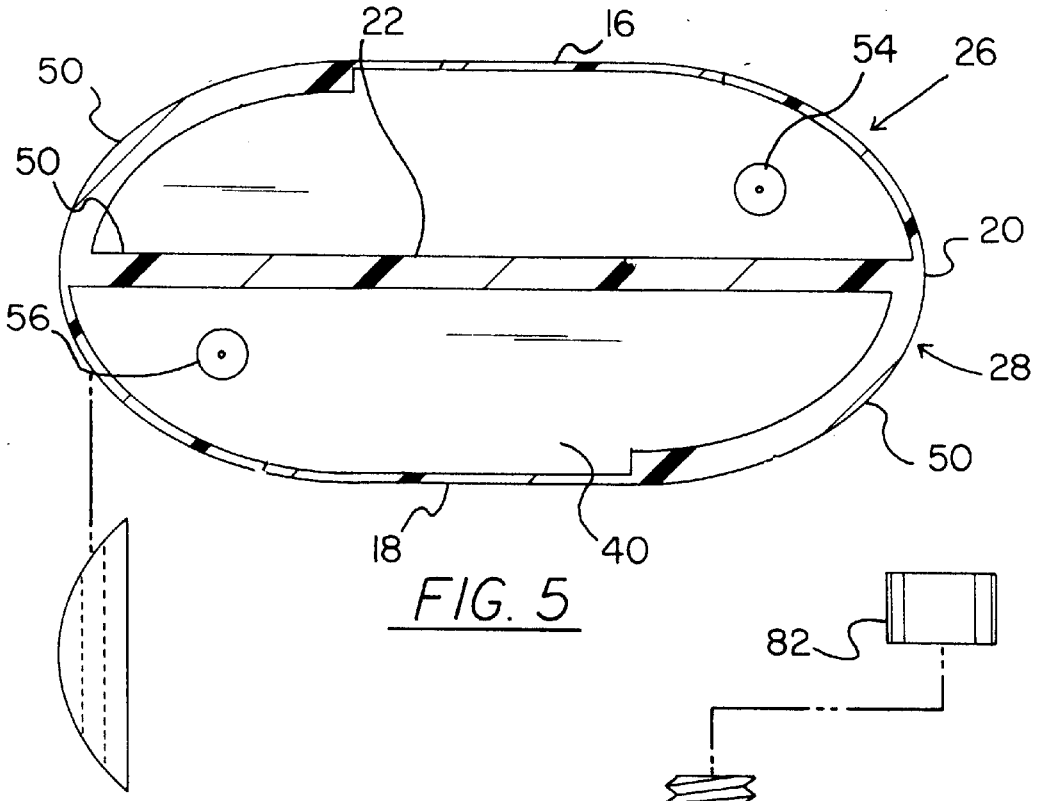
FIG. 5 is a cross-sectional view depicting the compartments of the interior space of the present invention. Such cross-sectional view is taken along line 5—5 shown in FIG. 1.

More specifically, it will be noted that the system 10 of the present invention includes an intermediate housing 12 with an oval horizontal cross-sectional. Such housing further has an oval top face 13, an oval bottom face 14, an arcuate front face 16, an arcuate rear face 18 and a pair of ends 20 defined by an interconnection between the front face. As shown in FIG. 5, the front and rear faces define an interior space. Such interior space has a rigid central vertical divider 22 integrally coupled between the ends and further between the top face and bottom face of the intermediate housing.

The divider partition the interior space thereby defining a front compartment 26 and a rear compartment 28. As can best be seen in FIG. 5, a first portion of the front face is rigid. In contrast, a second portion of the front face is flexible. With regard to the rear compartment 28, a first portion of the rear face is flexible. A second portion of the rear face is rigid. As can be seen in FIG. 5, the rigid portions of the front and rear compartments are integrally coupled to the central divider for the affording a central rigid frame 50 with a generally S-shaped cross-section. Further, the second flexible portions of the front and rear faces constitute ¾ the total surface area of such faces. In addition, such flexible portions are situated on opposite ends and on opposite faces of the housing and also are laterally offset.

As can be seen in FIG. 5, the rigid portions of the front and rear faces are afforded by the thickness of the housing being of a first thickness. The flexible portions of the front and rear faces are afforded by the thickness of the housing being of a second thickness that is no more than a ⅓ that of the first thickness. By this structure, the flexible portions are adapted to resume a prior shape after being squeezed. The elastomeric quality of the material from which the housing is constructed should be such that the forgoing rigidity and flexibility are afforded as a proper function of thickness.

Figure 4:
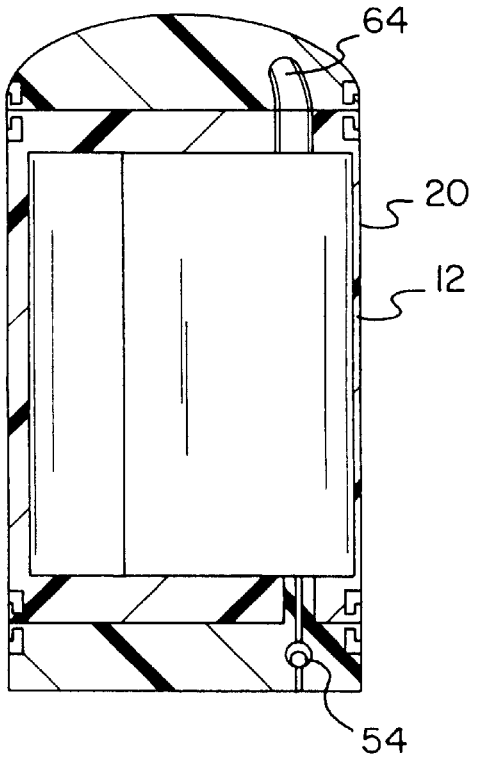
FIG. 4 is a cross-sectional view of the present invention taken along line 4—4 shown in FIG. 2.

With reference now to FIG. 4, a lower air release portion 52 is coupled to the bottom face of the intermediate housing. A first air release valve 54 resides in communication with the rear compartment of the housing. A second air release valve 56 is in communication with the front compartment of the housing. In operation, the valves are equipped with unillustrated springs to allow air to enter the respective compartment when a vacuum is afforded therein, as when a user ceases to squeeze the compartment. In addition, the valves are adapted to remain closed when the present invention is not in use and when the compartments is squeezed.

Further provided is an upper spout 60 coupled to the top face of the intermediate housing. The spout has a top opening 62 in communication with both the rear compartment of the housing and the front compartment of the housing. Such communication is composed of two separate channels 64 that diverge proximate to the top opening.

Associated therewith is a pair of one-way valves coupled between the top opening and the respective rear compartment and front compartment of the housing. Such valves are adapted for allowing fluid to exit the respective compartment to the top opening only upon the application of manual pressure to the intermediate housing. While not shown, the one-way valves include duckbill valves that are situated at the base of each respective channel and are coupled to the intermediate housing.

In use, the rear compartment and the front compartment of the housing may be depressed independently and coincidentally. As such, the present invention is adapted for dispensing liquids stored therein alone or in a mixture. The frame 50 is adapted to provide a rigid frame for gripping by the user. Such surface facilitates the use of the present invention to independently dispense the fluids.

In the preferred embodiment, the bottom portion and the spout are releasably coupled to the intermediate housing by means of a screwable coupling 70, a lock and groove fastener 72, or a combination thereof. As shown in the Figures, the lock and groove fasteners are situated on the ends of the housing adjacent the top and bottom faces thereof. The locks are adapted to engage a T-shaped groove 74 formed by the intermediate housing and the respective spout and lower portion. It should be understood that many other various types of couples may be employed to connect the various components of the present invention.

Figure 6:
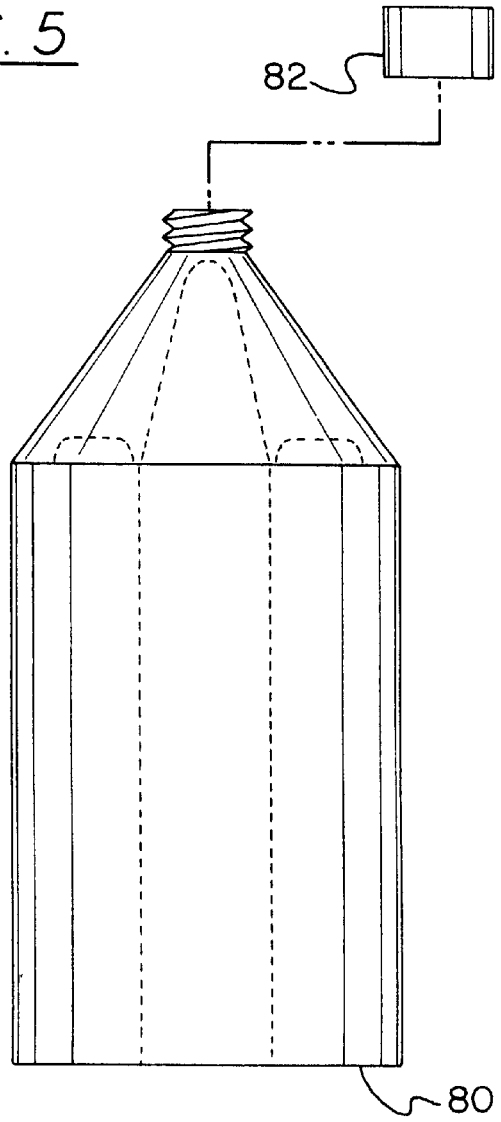
FIG. 6 is a side view of an alternate embodiment of the present invention.

In an alternate disposable embodiment shown in FIG. 6, the bottom air release valve portion is removed in favor of an integral bottom 80. In addition, the spout is integrally coupled to the intermediate housing. A screw cap 82 is also provided in the present embodiment for the purpose of selectively sealing the top opening.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the united states is as follows:

1. A new and improved two-fluid dispenser comprising, in combination:

an intermediate housing with an oval horizontal cross-section and having an oval top face, an oval bottom face, an arcuate front face, an arcuate rear face and a pair of ends defined by an interconnection between the front face and the rear face defining an interior space, the interior space having a rigid central vertical divider integrally coupled ends and the top face and bottom face of the intermediate housing thereby defining a front compartment and a rear compartment, a first portion of the front face being rigid and a second portion of the front face being flexible and a first portion of the rear face being rigid and a second portion of the rear face being flexible;

a lower air release portion coupled to the bottom face of the intermediate housing with a first air release valve in communication with the rear compartment of the housing and a second air release valve in communication with the front compartment of the housing;

an upper spout portion coupled to the top face of the intermediate housing with a top opening in communication with the rear compartment of the housing and the front compartment of the housing;

whereby the second portions of the front and rear faces of the housing are adapted to be depressed independently and coincidentally for dispensing liquids stored therein alone or in a mixture, respectively.

2. A two-fluid dispenser comprising:

a housing with a plurality of rigid walls, the housing having at least two squeezable compartments including a first compartment and a second compartment, each compartment having a flexible wall being coextensive with the rigid walls of the housing, the compartments adapted to be depressed independently and coincidentally for dispensing contents stored therein alone or in a mixture, respectively, and further including a first air release valve in communication with the first compartment and a second air release valve in communication with the second compartment.

* * * * *